US009672776B2

(12) United States Patent
Guo et al.

(10) Patent No.: US 9,672,776 B2
(45) Date of Patent: Jun. 6, 2017

(54) DRIVING CIRCUITS OF LIQUID CRYSTAL PANEL AND LIQUID CRYSTAL DEVICES

(71) Applicant: Shenzhen China Star Optoelectronics Technology Co., Ltd., Shenzhen, Guangdong (CN)

(72) Inventors: Chunpeng Guo, Guangdong (CN); Jiehui Qin, Guangdong (CN); Xiaoping Tan, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 83 days.

(21) Appl. No.: 14/433,634

(22) PCT Filed: Dec. 30, 2014

(86) PCT No.: PCT/CN2014/095568

§ 371 (c)(1),
(2) Date: Apr. 3, 2015

(87) PCT Pub. No.: WO2016/101309

PCT Pub. Date: Jun. 30, 2016

(65) Prior Publication Data

US 2016/0189640 A1 Jun. 30, 2016

(30) Foreign Application Priority Data

Dec. 24, 2014 (CN) ..... 2014 1 0818002

(51) Int. Cl.
*G09G 3/36* (2006.01)

(52) U.S. Cl.
CPC ..... *G09G 3/3607* (2013.01); *G09G 3/3614* (2013.01); *G09G 3/3688* (2013.01); *G09G 2300/0452* (2013.01); *G09G 2310/0297* (2013.01); *G09G 2330/021* (2013.01)

(58) Field of Classification Search
CPC .. G09G 3/3688; G09G 3/3607; G09G 3/3614; G09G 3/36; G09G 2330/021; G09G 2310/0297; G09G 2300/0452
USPC ..... 345/87–100, 690
See application file for complete search history.

(56) References Cited

U.S. PATENT DOCUMENTS 7,084,844 B2 * 8/2006 Yeo ..... G09G 3/3688 345/100
7,432,903 B2 * 10/2008 Kato ..... G09G 3/3614 345/98
8,310,507 B2 * 11/2012 Hiratsuka ..... G09G 3/3688 345/100

(Continued)

*Primary Examiner* — Vijay Shankar
(74) *Attorney, Agent, or Firm* — Andrew C. Cheng

(57) ABSTRACT

A driving circuit for liquid crystal panels and the liquid crystal devices are disclosed. The driving circuit includes a source driver, and at least one selection circuit. A number of the selection circuit is the same with the number of rows of the sub-pixel cells. Each of buffer data output ends of the source driver respectively connect to an input end of one selection circuit. A first output end of each of the selection circuit connects to the sub-pixel cells in one row. A second output end of each of the selection circuit connects to the sub-pixel cells in another row. The sub-pixel cells connecting with the first input end are within the same pixel row combination having the same color. In this way, the power consumption of the source driver of the driving circuit is reduced.

20 Claims, 4 Drawing Sheets

(56) References Cited

U.S. PATENT DOCUMENTS

| | | | | |
|---|---|---|---|---|
| 8,619,016 | B2 * | 12/2013 | Oelhafen | G09G 3/3688 345/100 |
| 2010/0013864 | A1 * | 1/2010 | Oelhafen | G09G 3/3688 345/690 |

* cited by examiner

DRIVING CIRCUITS OF LIQUID CRYSTAL PANEL AND LIQUID CRYSTAL DEVICES

BACKGROUND OF THE INVENTION

1. Field of the Invention

The present disclosure relates to liquid crystal display technology, and more particularly to a driving circuit of liquid crystal panels and liquid crystal devices.

2. Discussion of the Related Art

With respect to Thin film transistor (TFT) LCDs, the liquid crystal panels are driven by polarity inversion in order to extend the life cycle of the liquid crystal. The most popular polarity inversion methods are pixel dot-inversion and pixel column-inversion. Regarding the pixel dot-inversion, the polarity of the adjacent sub pixel cells are inversed. Regarding the column inversion, the polarity of the adjacent pixel cells are inversed.

However, when the above polarity inversion method is adopted, the level of each of the data lines has to be alternated between a positive polarity and a negative polarity very frequently, which has to be controlled by a source driver of the liquid crystal panel. Thus, the power consumption of the source driver is huge.

SUMMARY

According to the present disclosure, a driving circuit of the liquid crystal panels and the liquid crystal devices are provided to reduce the power consumption of the source driver within the driving circuit.

In one aspect, a liquid crystal device includes: a liquid crystal panel and a driving circuit for driving the liquid crystal panel, the liquid crystal panel being driven by a pixel dot-inversion or a pixel column-inversion, the liquid crystal panel comprises a plurality of pixel cells, and each of the pixel cells comprises three sub-pixel cells; when the liquid crystal panel is driven by the pixel dot-inversion or the pixel column-inversion, every two adjacent rows of pixel cells of the liquid crystal panel are combined into one pixel row combination; the driving circuit comprises a source driver, a control circuit, and at least one selection circuit, a number of the selection circuit is the same with the number of rows of the sub-pixel cells, each of buffer data output ends of the source driver respectively connect to an input end of one selection circuit, a first output end of each of the selection circuit connects to the sub-pixel cells in one row, a second output end of each of the selection circuit connects to the sub-pixel cells in another row, the sub-pixel cells connecting with the first input end, and the sub-pixel cells are within the same pixel row combination having the same color, the control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level; when the control end of the selection circuit being inputted with the first level, the input end of the selection circuit and the first output end are connected, the input end and the second output end are not connected, and the buffer data output end is configured to output the data signals of the sub-pixel cells connecting to the corresponding first output end of the selection circuit; and when the control end of the selection circuit being inputted with the second level, the input end of the selection circuit and the second output end are connected, the input end and the first output end are not connected, and the buffer data output end is configured to output the data signals of the sub-pixel cells connecting to the corresponding second output end of the selection circuit.

Wherein the selection circuit comprises a first switch and a second switch, the control end of the first switch being connected with the control end of the second switch so as to be the control end of the selection circuit, the input end of the first switch being connected with the input end of the second switch so as to be the input end of the selection circuit, the output end of the first switch is configured to be the first output end of the selection circuit, and the output end of the second switch is configured to be the second output end of the selection circuit.

Wherein the first switch is a Negative channel-metal-oxide-semiconductor (NMOS) transistor, and the second switch is a positive channel metal oxide semiconductor (PMOS) transistor.

Wherein the control ends of all of the selection circuit being connected to the same output end of the control circuit.

In another aspect, a driving circuit for liquid crystal panels includes: the liquid crystal panel is driven by a pixel dot-inversion or a pixel column-inversion, the liquid crystal panel comprises a plurality of pixel cells, and each of the pixel cells comprises three sub-pixel cells; when the liquid crystal panel is driven by the pixel dot-inversion, every two adjacent rows of pixel cells of the liquid crystal panel are combined into one pixel row combination, and when the liquid crystal panel is driven by the pixel column-inversion, every two rows of pixel cells of the liquid crystal panel having opposite polarity are combined into one pixel row combination; the driving circuit comprises a source driver, and at least one selection circuit, a number of the selection circuit is the same with the number of rows of the sub-pixel cells, each of buffer data output ends of the source driver respectively connect to an input end of one selection circuit, a first output end of each of the selection circuit connects to the sub-pixel cells in one row, a second output end of each of the selection circuit connects to the sub-pixel cells in another row, the sub-pixel cells connecting with the first input end, and the sub-pixel cells are within the same pixel row combination having the same color; when the control end of the selection circuit being inputted with the first level, the input end of the selection circuit and the first output end are connected, the input end and the second output end are not connected, and the buffer data output end is configured to output the data signals of the sub-pixel cells connecting to the corresponding first output end of the selection circuit; and when the control end of the selection circuit being inputted with the second level, the input end of the selection circuit and the second output end are connected, the input end and the first output end are not connected, and the buffer data output end is configured to output the data signals of the sub-pixel cells connecting to the corresponding second output end of the selection circuit.

Wherein the selection circuit comprises a first switch and a second switch, the control end of the first switch being connected with the control end of the second switch so as to be the control end of the selection circuit, the input end of the first switch being connected with the input end of the second switch so as to be the input end of the selection circuit, the output end of the first switch is configured to be the first output end of the selection circuit, and the output end of the second switch is configured to be the second output end of the selection circuit.

Wherein the first switch is a Negative channel-metal-oxide-semiconductor (NMOS) transistor, and the second switch is a positive channel metal oxide semiconductor (PMOS) transistor.

Wherein when the liquid crystal panel is driven by the pixel dot-inversion or the pixel column-inversion, every two adjacent rows of pixel cells of the liquid crystal panel are combined into one pixel row combination.

Wherein when the liquid crystal panel is driven by the pixel dot-inversion or the pixel column-inversion, every two adjacent rows of pixel cells of the liquid crystal panel are combined into one pixel row combination.

Wherein when the liquid crystal panel is driven by the pixel dot-inversion or the pixel column-inversion, every two adjacent rows of pixel cells of the liquid crystal panel are combined into one pixel row combination.

Wherein the driving circuit further comprises a control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level.

Wherein the driving circuit further comprises a control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level.

Wherein the driving circuit further comprises a control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level.

Wherein the control ends of all of the selection circuit being connected to the same output end of the control circuit.

In another aspect, a liquid crystal devices includes: a liquid crystal panel and a driving circuit for driving the liquid crystal panel, the liquid crystal panel being driven by a pixel dot-inversion or a pixel column-inversion, the liquid crystal panel comprises a plurality of pixel cells, and each of the pixel cells comprises three sub-pixel cells; when the liquid crystal panel is driven by the pixel dot-inversion, every two adjacent rows of pixel cells of the liquid crystal panel are combined into one pixel row combination, and when the liquid crystal panel is driven by the pixel column-inversion, every two rows of pixel cells of the liquid crystal panel having opposite polarity are combined into one pixel row combination; the driving circuit comprises a source driver, and at least one selection circuit, a number of the selection circuit is the same with the number of rows of the sub-pixel cells, each of buffer data output ends of the source driver respectively connect to an input end of one selection circuit, a first output end of each of the selection circuit connects to the sub-pixel cells in one row, a second output end of each of the selection circuit connects to the sub-pixel cells in another row, the sub-pixel cells connecting with the first input end, and the sub-pixel cells are within the same pixel row combination having the same color; when the control end of the selection circuit being inputted with the first level, the input end of the selection circuit and the first output end are connected, the input end and the second output end are not connected, and the buffer data output end is configured to output the data signals of the sub-pixel cells connecting to the corresponding first output end of the selection circuit; and when the control end of the selection circuit being inputted with the second level, the input end of the selection circuit and the second output end are connected, the input end and the first output end are not connected, and the buffer data output end is configured to output the data signals of the sub-pixel cells connecting to the corresponding second output end of the selection circuit.

Wherein the selection circuit comprises a first switch and a second switch, the control end of the first switch being connected with the control end of the second switch so as to be the control end of the selection circuit, the input end of the first switch being connected with the input end of the second switch so as to be the input end of the selection circuit, the output end of the first switch is configured to be the first output end of the selection circuit, and the output end of the second switch is configured to be the second output end of the selection circuit.

Wherein when the liquid crystal panel is driven by the pixel dot-inversion or the pixel column-inversion, every two adjacent rows of pixel cells of the liquid crystal panel are combined into one pixel row combination.

Wherein when the liquid crystal panel is driven by the pixel dot-inversion or the pixel column-inversion, every two adjacent rows of pixel cells of the liquid crystal panel are combined into one pixel row combination.

Wherein the driving circuit further comprises a control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level.

Wherein the driving circuit further comprises a control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level.

In view of the above, the selection circuit 122 is arrange between the buffer data output end 1212 of the driving circuit and the sub-pixel cells. The first and second output ends of the selection circuit respectively connect to the sub-pixel cells in two rows within the pixel row combination having the same color. As such, the buffer data output end 1212 is configured to selectively connect with the sub-pixel cells in two rows within the same pixel row combination 114 having the same color. Within the same pixel row combination, regardless of being driven by pixel dot-inversion or by pixel column-inversion, the polarity of the sub-pixel cells in two rows having the same color is inversed. Thus, the polarity of the sub-pixel cells in the same row, which connect to the buffer data output end, may remain the same by inputting corresponding level signals to the control end of the selection circuit. That is, the polarity of the data signals outputted by the buffer data output end may remain the same by inputting corresponding level signals to the control end of the selection circuit. This not only decreases the voltage difference of the gate driver of the driving circuit, but also reduces the power consumption and the temperature of the gate driving circuit.

DETAILED DESCRIPTION OF THE EMBODIMENTS

Embodiments of the invention will now be described more fully hereinafter with reference to the accompanying drawings, in which embodiments of the invention are shown.

Figure 1:
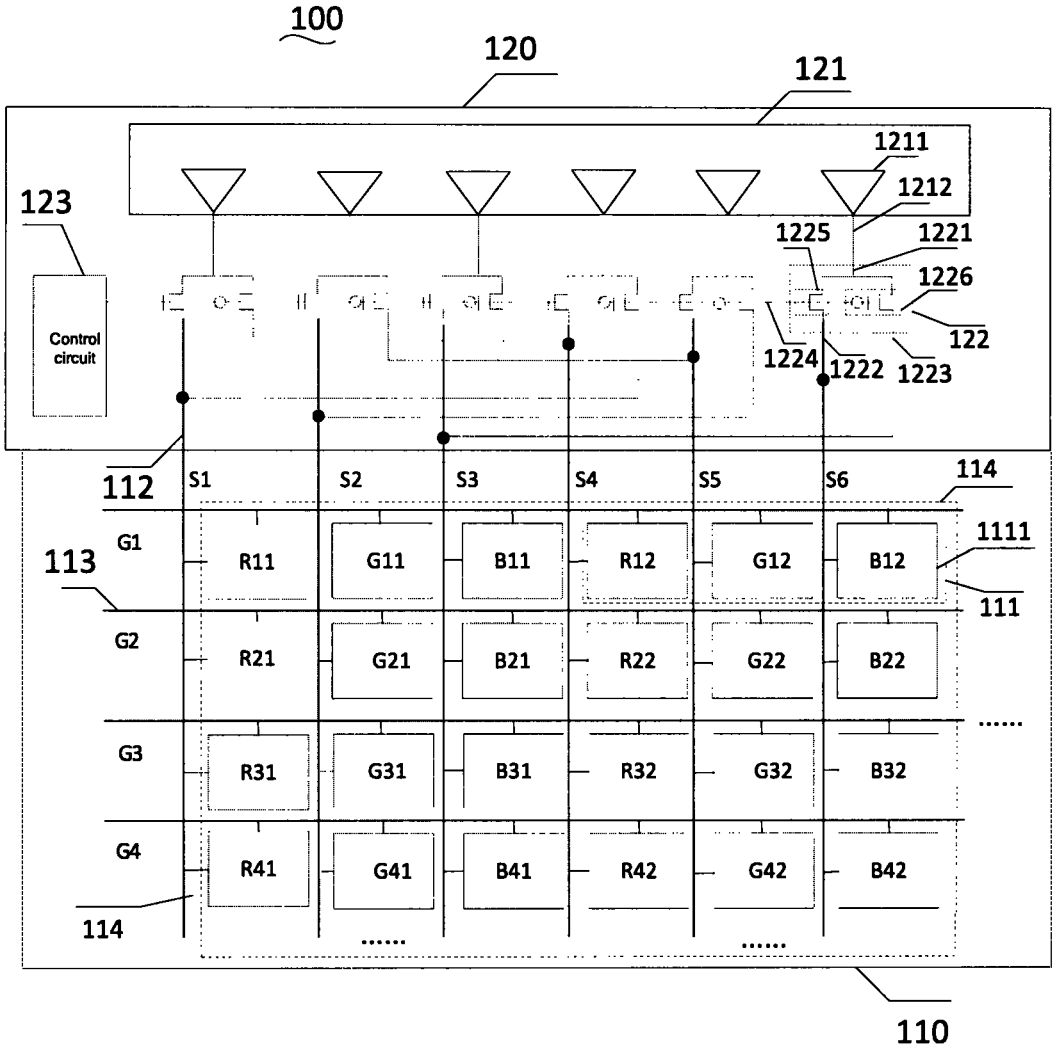
FIG. 1 is a schematic view of the liquid crystal device in accordance with one embodiment.

FIG. 1 is a schematic view of the liquid crystal device in accordance with one embodiment. The liquid crystal device 100 includes a liquid crystal panel 110 and a driving circuit 120 for driving the liquid crystal panel 110.

In the embodiment, the liquid crystal panel 110 includes a plurality of pixel cells 111, a data line 112, and a scanning line 113. Each of the pixel cells 111 includes three sub-pixel cells 1111 respectively indicative of red, green, blue colors. In the embodiment, the sub-pixel cells are driven by TFTs. Each of the data lines 112 is arranged along a column direction, and is electrically connected with the sub-pixel cells 1111 within the same column so as to provide the data signals from the driving circuit 120 to the sub-pixel cells 1111. Each of the scanning lines 113 is arranged along a row direction, and is electrically connected with the sub-pixel cells 1111 within the same row so as to provide the scanning signals from the driving circuit 120 to the sub-pixel cells 1111.

Figure 2:
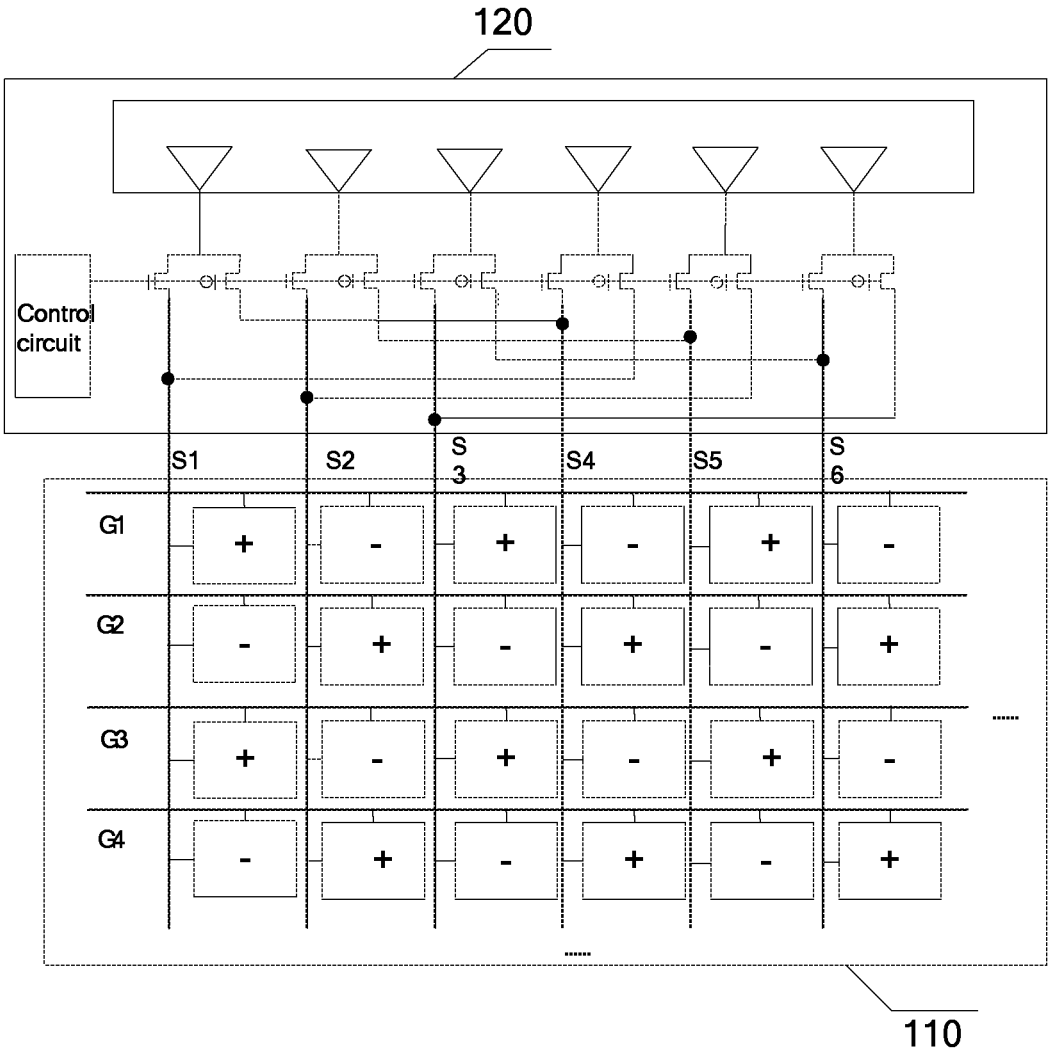
FIG. 2 is a schematic view of the liquid crystal panel driven by the pixel dot-inversion in accordance with one embodiment.
Figure 3:
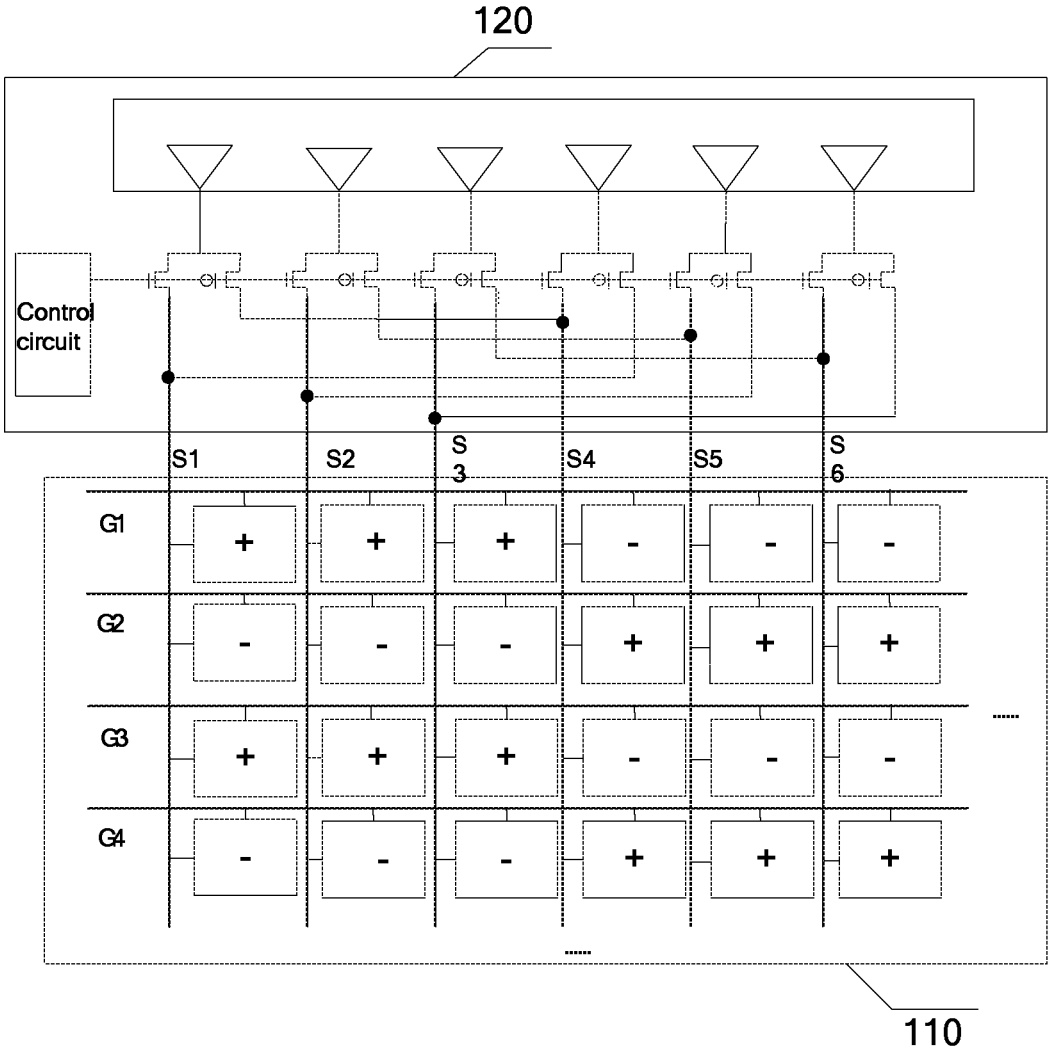
FIG. 3 is a schematic view of the liquid crystal panel driven by pixel column-inversion in accordance with another embodiment.

In the embodiment, the liquid crystal panel is driven by the pixel dot-inversion or the pixel column-inversion. Regarding the pixel dot-inversion, the polarity of the adjacent sub-pixel cells 1111 of the liquid crystal panel 110 are different, as shown in FIG. 2. Regarding the pixel column-inversion, the polarity of the adjacent pixel cells 111 of the liquid crystal panel 110 are different, as shown in FIG. 3.

The liquid crystal panel 110 is divided into a plurality of pixel row combinations 114. When the liquid crystal panel 110 is driven by the pixel dot-inversion, any two rows of pixel cells 111 form the pixel row combination 114, and each of the pixel cell 111 includes the sub-pixel cells 1111 arranged in three columns. In an example, every two adjacent rows of pixel cells 111 are combined into one pixel row combination 114, such as the pixel cells in the n-th row and in the (n+1)-th row. In another example, every two adjacent odd rows or even rows of pixel cells 111 are combined into one pixel row combination 114, such as the pixel cells in the n-th row and in the (n+2)-th row.

When the liquid crystal panel 110 is driven by the pixel column-inversion, two adjacent rows of pixel cells having opposite polarity are combined into one pixel row combination 114. In an example, every two adjacent rows of pixel cells 111 of the liquid crystal panel 110 are combined into one pixel row combination 114, such as the pixel cells in the n-th row and in the (n+1)-th row. In another example, an arbitrary odd row and an arbitrary even row of pixel cells 111 are combined into one pixel row combination 114.

The driving circuit 120 includes a source driver 121, a control circuit 123, and at least one selection circuit 122. The number of the selection circuit 122 is the same with the number of rows of the sub-pixel cells 1111.

The source driver 121 is configured for providing the data signals for the pixel cells 111 of the liquid crystal panel 110. In an example, the source driver 121 includes a plurality of buffers 1211 for respectively stored the data signals of the sub-pixel cells 1111. In addition, output ends 1212 of the buffers 1211 are configured to output the data signals to an input end 1221 of the selection circuit 122.

The control circuit 123 is configured for outputting a first level or a second level so as to select a first output end or a second output end of the selection circuit. In an example, the output end of the control circuit 123 is connected with control ends 1224 of all of the selection circuits 122. It can be understood that the control circuit 123 may connect to the control ends of all of the selection circuit 122 via one output end, as shown in FIG. 1. Alternatively, the control circuit 123 may be connected to the control end 1224 of different selection circuit via different output end. Thus, the connection between the control circuit 123 and the control end 1224 of the selection circuit is not limited thereto.

The first output end and the second output end of the selection circuit 122 are connected with the sub-pixel cells 1111 arranged in two rows for being controlled by the control circuit 123. As such, the data signals from the source driver 121 may be outputted to the sub-pixel cells 1111 of the first output end or of the second output end. In the embodiment, the first output end 1222 of each of the selection circuit 122 is respectively connected with one data line 112 of the liquid crystal panel 110 so as to connect with the sub-pixel cells 1111 of one row via the data line 112. The second output end 1223 of each of the selection circuit 122 is connected with the other data line 112 of the liquid crystal panel 110. As such, the first output end and the second output end of each of the selection circuit 122 is configured for connecting the sub-pixel cells 1111 located in two rows within the same pixel row combination 114 having the same colors.

In the embodiment, the selection circuit 122 includes a first switch 1225 and a second switch 1226. The control end of the first switch 1225 connected with the control end of the second switch 1226 so as to be the control end 1224 of the selection circuit 122. The input end of the first switch 1225 is connected with the input end of the second switch 1226 so as to be the input end 1221 of the selection circuit 122. The output end of the first switch 1225 may operate as the first output end 1222 of the selection circuit 122. The output end of the second switch 1226 may operate as may operate as the second output end 1223 of the selection circuit 122. The first switch 1225 and the second switch 1226 may be turn on in response to different conditions. When the first switch 1225 is turn on, the second switch 1226 is not turned on. When the second switch 1226 is turn on, the first switch 1225 is not turned on. Specifically, the first switch 1225 may be a Negative channel-metal-oxide-semiconductor (NMOS) transistor. The second switch 1226 may be a positive channel metal oxide semiconductor (PMOS) transistor.

As shown in FIG. 1, the every two adjacent rows of the pixel cells 111 of the liquid crystal panel 110 form the pixel row combination 114. Taking the pixel row combination 114 formed by the pixel cells 111 in the first row and in the second row as an example, each of the pixel row combination 114 connects to correspondingly six selection circuit 122. Each of the selection circuit 122 connects to a buffer data output end 1212. The first output ends of the three selection circuits 122 corresponding to the pixel cells 111 in the first row respectively connect to the data line (S1, S2, S3) of the RGB subpixel cells in the first row. The second output ends of the three selection circuits 122 corresponding to the pixel cells 111 in the second row respectively connect to the data line (S4, S5, S6) of the RGB subpixel cells in the second row.

Figure 4:
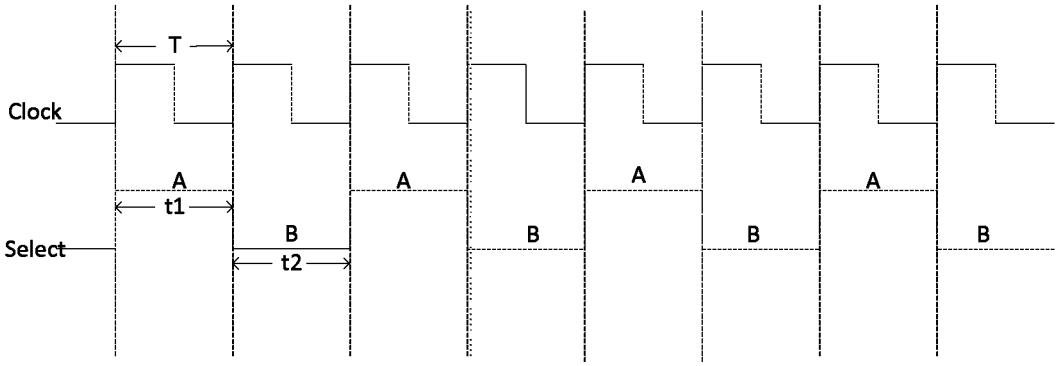
FIG. 4 is a first schematic view of the control signals outputted by the control circuit of the driving circuit of FIG. 1.

In the embodiment, the control circuit 123 is configured for outputting the control signals having a periodical first level (A) and a periodical second level (B), as shown as the selection signals in FIG. 4. The scanning clock signals provided to the liquid crystal panel 110 are as shown as the Clock signals in FIG. 4. The period (T) of the scanning clock signals equals to the time period (t1) for outputting the first level (A) and the time period (t2) for outputting the second level (B) by the control circuit 123. As such, the scanning frequency of the sub-pixel cells in each column is substantially the same with the switching frequency of the sub-pixel cells located in two rows connected with the first output end and the second output end.

When the control circuit 123 inputs the first level to the control end 1224 of the selection circuit 122, the input end 1221 of the selection circuit 122 and the first output end 1222 are connected. In addition, the second output end 1223 of the input end 1221 are not connected. At this moment, the buffer data output end 1212 connected with the input end 1221 of the selection circuit 122 connects with the first output end so as to output the buffered data signals to the data line connected with the first output end. At this moment, the buffer data output end 1212 connects with the first output end 1222 of the selection circuit 122, and thus the buffer data output end 1212 outputs the data signals of the sub-pixel cells 1111 connecting to the corresponding first output end 1222 of the selection circuit 122. In an example, when the sub-pixel cells in the n-th row connects with the first output end 1222 of the selection circuit 122, the sub-pixel cells in the m-th row are turn on by the scanning signals. The data signals corresponding to the sub-pixel cells are the data signals of the sub-pixel cells 1111 in the n-th row and the m-th column.

When the control circuit 123 inputs the second level to the control end 1224 of the selection circuit 122, the input end 1221 of the selection circuit 122 is connected with the selection circuit 122. In addition, the input end 1221 and the first output end 1222 are not connected. At this moment, the buffer data output end 1212 connected with the input end 1221 of the selection circuit 122 connects with the second output end of the selection circuit 122 so as to output the buffered data signals to the data line connected with the second output end. At this moment, the buffer data output end 1212 is connected with the second output end 1223 of the selection circuit 122, and thus the buffer data output end 1212 outputs the data signals of the corresponding sub-pixel cells 1111 connected with the second output end 1223 of the selection circuit 122. In an example, the second output end 1223 of the selection circuit 122 connects with the sub-pixel cells in the k-th row. The sub-pixel cells in the m-th column are turned on by the scanning signals. The data signals corresponding to the sub-pixel cells are the data signals of the sub-pixel cells 1111 in the k-th row and in the m-th column.

Figure 5:
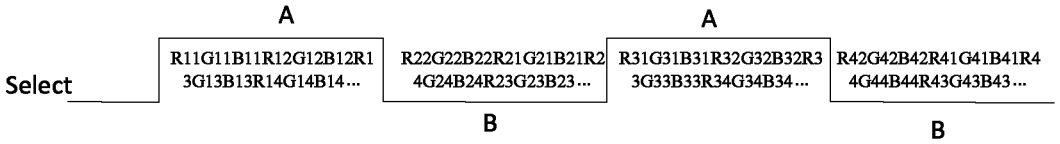
FIG. 5 is a second schematic view of the control signals outputted by the control circuit of the driving circuit of FIG. 1.

As shown in FIG. 1, when the control circuit 123 inputs the first level, the buffer data output ends of the first and the second row pixel combinations 114 respectively connects to the data line S1, S2, S3, S4, S5, and S6. When the control circuit 123 inputs the second level, the buffer data output ends of the first and the second row pixel combinations 114 respectively connects to the data line S4, S5, S6, S1, S2, and S3. The data signals outputted by the output ends 1212 for storing the data from left to the right are as shown in FIG. 5. When the control circuit 123 inputs the first level, the scanning circuit turns on the sub-pixel cells 1111 located in the n-th row. The output ends 1212 for storing the data from left to the right correspondingly output the data signals including Rn1, Gn1, Bn1, Rn2, Gn2, Bn2, Rn3, Gn3, Bn3, Rn4, Gn4, Bn4, and so on. When the control circuit 123 inputs the first level, the sub-pixel cells 1111 located in the k-th row. The output ends 1212 for storing the data from left to the right correspondingly output the data signals including Rk2, Gk2, Bk2, Rk1, Gk1, Bk1, Rk4, Gk4, Bk4, Rk3, Gk3, Bk3, and so on.

In the embodiment, as the liquid crystal panel may be pixel dot-inversion or the pixel column-inversion, the polarity of the sub-pixel cells having the same color within the same pixel row combination are inversed. Referring to FIG. 1, when the R11 is of the positive polarity, the R12 is of the negative polarity, the R21 is of the negative polarity, the R22 is of the positive polarity, the R31 is of the positive polarity, the R32 is of the negative polarity, and the polarity of other sub-pixel cells may be referred in a similar way. As shown in FIG. 5, by adopting the above driving circuit, the three buffer data output ends connected to the pixel cells in the first row outputs the data signals R11G11B11, R22G22B22, R31G31B31, R42G42B42 in sequence. The polarity of the data signals are of the same polarity. The three buffer data output ends connected to the pixel cells in the second row outputs the data signals R12G12B12, R21G21B21, R32G32B32, R41G41B41 in sequence. The polarity of the data signals are of the same polarity. Thus, each of the buffer data output ends of the driving circuit are configured to output the data signals of the same polarity, such as positive polarity or negative polarity, when being driven. As such, the voltage difference of the source driver is reduced so as to reduce the power consumption and the temperature of the source driver.

According to the present disclosure, a liquid crystal panel includes the above driving circuit as shown in FIG. 1.

In view of the above, the selection circuit 122 is arrange between the buffer data output end 1212 of the driving circuit and the sub-pixel cells. The first and second output ends of the selection circuit respectively connect to the sub-pixel cells in two rows within the pixel row combination having the same color. As such, the buffer data output end 1212 is configured to selectively connect with the sub-pixel cells in two rows within the same pixel row combination 114 having the same color. Within the same pixel row combination, regardless of being driven by pixel dot-inversion or by pixel column-inversion, the polarity of the sub-pixel cells in two rows having the same color is inversed. Thus, the polarity of the sub-pixel cells in the same row, which connect to the buffer data output end, may remain the same by inputting corresponding level signals to the control end of the selection circuit. That is, the polarity of the data signals outputted by the buffer data output end may remain the same by inputting corresponding level signals to the control end of the selection circuit. This not only decreases the voltage difference of the gate driver of the driving circuit, but also reduces the power consumption and the temperature of the gate driving circuit.

In several of examples provided herein, it should be understood that the disclosed systems, devices and methods may be realized by other ways. For example, the system described above embodiments are merely illustrative in nature, for example, the division of the modules or units.

There may be other ways of dividing the actual implementation. For example, a plurality of units or components may be combined or can be integrated into another system or certain features may be omitted, or not implemented. In addition, the devices or components may be coupled or directly coupled or communicating with each other via some interfaces. The devices and units may be coupled in electrical, mechanical, or other ways.

The unit described as separate components may be or may not be physically separated, as a component of the display unit may be or may not be physical units, i.e. may be located in one place, or may be distributed to a plurality of network units. A portion or all of the units may be selected so as to achieve the technical features of the claimed invention.

Further, in this embodiment each of the functional units may be integrated in various embodiments of the present invention, in one processing unit, each unit may be a separate physical presence, or two or more units may be integrated in one unit. The integrated units may be implemented by hardware or by software function modules.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A liquid crystal device, comprising:

a liquid crystal panel and a driving circuit for driving the liquid crystal panel, the liquid crystal panel being driven by a pixel dot-inversion or a pixel column-inversion, the liquid crystal panel comprises a plurality of pixel cells, and each of the pixel cells comprises three sub-pixel cells;

when the liquid crystal panel is driven by the pixel dot-inversion or the pixel column-inversion, every two adjacent rows of pixel cells of the liquid crystal panel are combined into one pixel row combination;

the driving circuit comprises a source driver, a control circuit, and at least one selection circuit, a number of the selection circuit is the same with the number of rows of the sub-pixel cells, each of buffer data output ends of the source driver respectively connect to an input end of one selection circuit, a first output end of each of the selection circuit connects to the sub-pixel cells in one row, a second output end of each of the selection circuit connects to the sub-pixel cells in another row, the sub-pixel cells connecting with the first input end, and the sub-pixel cells are within the same pixel row combination having the same color, the control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level;

when the control end of the selection circuit being inputted with the first level, the input end of the selection circuit and the first output end are connected, the input end and the second output end are not connected, and the buffer data output end is configured to output the data signals of the sub-pixel cells connecting to the corresponding first output end of the selection circuit; and when the control end of the selection circuit being inputted with the second level, the input end of the selection circuit and the second output end are connected, the input end and the first output end are not connected, and the buffer data output end is configured to output the data signals of the sub-pixel cells connecting to the corresponding second output end of the selection circuit.

2. The liquid crystal device as claimed in claim 1, wherein the selection circuit comprises a first switch and a second switch, the control end of the first switch being connected with the control end of the second switch so as to be the control end of the selection circuit, the input end of the first switch being connected with the input end of the second switch so as to be the input end of the selection circuit, the output end of the first switch is configured to be the first output end of the selection circuit, and the output end of the second switch is configured to be the second output end of the selection circuit.

3. The liquid crystal device as claimed in claim 2, wherein the first switch is a Negative channel-metal-oxide-semiconductor (NMOS) transistor, and the second switch is a positive channel metal oxide semiconductor (PMOS) transistor.

4. The liquid crystal device as claimed in claim 1, wherein the control ends of all of the selection circuit being connected to the same output end of the control circuit.

5. A driving circuit for liquid crystal panels, comprising:

the liquid crystal panel is driven by a pixel dot-inversion or a pixel column-inversion, the liquid crystal panel comprises a plurality of pixel cells, and each of the pixel cells comprises three sub-pixel cells;

when the liquid crystal panel is driven by the pixel dot-inversion, every two adjacent rows of pixel cells of the liquid crystal panel are combined into one pixel row combination, and when the liquid crystal panel is driven by the pixel column-inversion, every two rows of pixel cells of the liquid crystal panel having opposite polarity are combined into one pixel row combination;

the driving circuit comprises a source driver, and at least one selection circuit, a number of the selection circuit is the same with the number of rows of the sub-pixel cells, each of buffer data output ends of the source driver respectively connect to an input end of one selection circuit, a first output end of each of the selection circuit connects to the sub-pixel cells in one row, a second output end of each of the selection circuit connects to the sub-pixel cells in another row, the sub-pixel cells connecting with the first input end, and the sub-pixel cells are within the same pixel row combination having the same color;

when the control end of the selection circuit being inputted with the first level, the input end of the selection circuit and the first output end are connected, the input end and the second output end are not connected, and the buffer data output end is configured to output the data signals of the sub-pixel cells connecting to the corresponding first output end of the selection circuit; and when the control end of the selection circuit being inputted with the second level, the input end of the selection circuit and the second output end are connected, the input end and the first output end are not connected, and the buffer data output end is configured to output the data signals of the sub-pixel cells connecting to the corresponding second output end of the selection circuit.

6. The driving circuit as claimed in claim 5, wherein the selection circuit comprises a first switch and a second switch, the control end of the first switch being connected with the control end of the second switch so as to be the control end of the selection circuit, the input end of the first switch being connected with the input end of the second switch so as to be the input end of the selection circuit, the output end of the first switch is configured to be the first output end of the selection circuit, and the output end of the second switch is configured to be the second output end of the selection circuit.

7. The driving circuit as claimed in claim 6, wherein the first switch is a Negative channel-metal-oxide-semiconductor (NMOS) transistor, and the second switch is a positive channel metal oxide semiconductor (PMOS) transistor.

8. The driving circuit as claimed in claim 5, wherein when the liquid crystal panel is driven by the pixel dot-inversion or the pixel column-inversion, every two adjacent rows of pixel cells of the liquid crystal panel are combined into one pixel row combination.

9. The driving circuit as claimed in claim 6, wherein when the liquid crystal panel is driven by the pixel dot-inversion or the pixel column-inversion, every two adjacent rows of pixel cells of the liquid crystal panel are combined into one pixel row combination.

10. The driving circuit as claimed in claim 7, wherein when the liquid crystal panel is driven by the pixel dot-inversion or the pixel column-inversion, every two adjacent rows of pixel cells of the liquid crystal panel are combined into one pixel row combination.

11. The driving circuit as claimed in claim 5, wherein the driving circuit further comprises a control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level.

12. The driving circuit as claimed in claim 6, wherein the driving circuit further comprises a control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level.

13. The driving circuit as claimed in claim 7, wherein the driving circuit further comprises a control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level.

14. The driving circuit as claimed in claim 1, wherein the control ends of all of the selection circuit being connected to the same output end of the control circuit.

15. A liquid crystal device, comprising:

a liquid crystal panel and a driving circuit for driving the liquid crystal panel, the liquid crystal panel being driven by a pixel dot-inversion or a pixel column-inversion, the liquid crystal panel comprises a plurality of pixel cells, and each of the pixel cells comprises three sub-pixel cells;

when the liquid crystal panel is driven by the pixel dot-inversion, every two adjacent rows of pixel cells of the liquid crystal panel are combined into one pixel row combination, and when the liquid crystal panel is driven by the pixel column-inversion, every two rows of pixel cells of the liquid crystal panel having opposite polarity are combined into one pixel row combination;

the driving circuit comprises a source driver, and at least one selection circuit, a number of the selection circuit is the same with the number of rows of the sub-pixel cells, each of buffer data output ends of the source driver respectively connect to an input end of one selection circuit, a first output end of each of the selection circuit connects to the sub-pixel cells in one row, a second output end of each of the selection circuit connects to the sub-pixel cells in another row, the sub-pixel cells connecting with the first input end, and the sub-pixel cells are within the same pixel row combination having the same color;

when the control end of the selection circuit being inputted with the first level, the input end of the selection circuit and the first output end are connected, the input end and the second output end are not connected, and the buffer data output end is configured to output the data signals of the sub-pixel cells connecting to the corresponding first output end of the selection circuit; and when the control end of the selection circuit being inputted with the second level, the input end of the selection circuit and the second output end are connected, the input end and the first output end are not connected, and the buffer data output end is configured to output the data signals of the sub-pixel cells connecting to the corresponding second output end of the selection circuit.

16. The liquid crystal device as claimed in claim 15, wherein the selection circuit comprises a first switch and a second switch, the control end of the first switch being connected with the control end of the second switch so as to be the control end of the selection circuit, the input end of the first switch being connected with the input end of the second switch so as to be the input end of the selection circuit, the output end of the first switch is configured to be the first output end of the selection circuit, and the output end of the second switch is configured to be the second output end of the selection circuit.

17. The liquid crystal device as claimed in claim 15, wherein when the liquid crystal panel is driven by the pixel dot-inversion or the pixel column-inversion, every two adjacent rows of pixel cells of the liquid crystal panel are combined into one pixel row combination.

18. The liquid crystal device as claimed in claim 16, wherein when the liquid crystal panel is driven by the pixel dot-inversion or the pixel column-inversion, every two adjacent rows of pixel cells of the liquid crystal panel are combined into one pixel row combination.

19. The liquid crystal device as claimed in claim 15, wherein the driving circuit further comprises a control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level.

20. The liquid crystal device as claimed in claim 16, wherein the driving circuit further comprises a control circuit being connected to control ends of all of the selection circuit so as to periodically input a first level and a second level to the control end of the selection circuit, wherein within each period, a time period of scanning clock signals of the liquid crystal panel equals to the time period of the first level and the time period of the second level.

* * * * *